United States Patent [19]

Dutt

[11] Patent Number: 5,020,686

[45] Date of Patent: Jun. 4, 1991

[54] CLOSURE FOR A RESEALABLE CONTAINER

[75] Inventor: Herbert V. Dutt, Sarasota, Fla.

[73] Assignee: Continental Plastics, Inc., Triadelphia, W. Va.

[21] Appl. No.: 443,610

[22] Filed: Nov. 29, 1989

[51] Int. Cl.[5] ..... B65D 41/32

[52] U.S. Cl. ..... 220/276; 220/270; 220/269

[58] Field of Search ..... 220/276, 212, 254, 265, 220/268, 270; 215/253

[56] References Cited

U.S. PATENT DOCUMENTS

| | | | |
|---|---|---|---|
| 2,102,440 | 12/1937 | Sebell | 220/276 X |
| 3,108,708 | 10/1963 | Betner . | |
| 3,494,500 | 2/1970 | Foster . | |
| 3,624,789 | 11/1971 | Peyser et al. | 220/270 X |
| 3,998,354 | 12/1976 | Song . | |
| 4,146,148 | 3/1979 | Dwinell et al. | 220/270 |
| 4,154,360 | 5/1979 | Smith | 220/380 X |
| 4,433,793 | 2/1984 | Ingemann . | |
| 4,434,907 | 3/1984 | Ingemann . | |
| 4,442,950 | 4/1984 | Wilson . | |
| 4,529,100 | 7/1985 | Ingemann . | |

*Primary Examiner*—Stephen Marcus
*Assistant Examiner*—Vanessa M. Roberts
*Attorney, Agent, or Firm*—Richard V. Westerhoff; David V. Radack

[57] ABSTRACT

A closure for a resealable container comprising an annular container engaging member fixedly attached to the edge of the container and a lid having an end wall and an annular skirt, the lid being attached to and separable from the container engaging member at a failure zone. In one embodiment the lid is adapted to reseal the container after it is separated from the container engaging member by turning the lid upside down and positioning it such that the annular skirt engages the container engaging member and the end wall covers at least a portion of the opening of the container. In another embodiment, the lid is also adapted to reseal the container after it is separated from the container engaging member by positioning the lid such that the annular skirt engages the container engaging member and the end wall covers at least a portion of the opening of the container. The invention also includes a stackable container having the closure described above.

16 Claims, 4 Drawing Sheets

CLOSURE FOR A RESEALABLE CONTAINER

BACKGROUND OF THE INVENTION

1. Field of the Invention

This invention relates to a closure for a resealable container, and more particularly to a closure having a container engaging member fixedly attached to the container and lid which is attached to and removable from the container engaging member at a failure zone. After separation, the lid can be used to reseal the container.

2. Background Information

It is well known to provide containers having a sealed closure and a plastic lid. Typically, the sealed closure is removed from the container by engaging a pull ring and tearing the closure from the container. The closure is then discarded and the plastic lid is used to reseal the container.

It is also known to provide a closure which also acts as a lid after it is separated from the container. U.S. Pat. No. 4,433,793 discloses a container and closure, the closure including a flange which is ultrasonically welded onto the edge of the container and a lid which is attached to the flange at a score line. Downward pressure on the lid separates the lid from the flange and also causes the lid to bottom out on an annular ledge formed by the container. Upstanding stiffening ribs are then grasped to pull the lid out of the container. To reseal the container, the lid is pressed downward to form an airtight seal with the annular wall of the container. The patent also discloses that the lid shape permits stacking of the containers. See also, U.S. Pat. Nos. 4,434,907 and 4,529,100.

U.S. Pat. No. 3,998,354 discloses a reusable plastic cover in which the lid is secured to the body part by a thin section forming a score line. A lip on the lid at the score line engages a ledge under the body part to reseal the lid to the body part after the lid has been separated therefrom.

Despite these closures, there remains a need for a resealable closure that has a container engaging member fixedly attached to the container to which a lid is removably attached, the lid being adapted to reseal the container after removal therefrom by engaging the container engaging member. Also, there remains a need for a container that can be stacked on top of another container without the top container resting on the lid of the bottom container.

SUMMARY OF THE INVENTION

The present invention satisfies the above-described needs. The closure comprises an annular container engaging member fixedly attached to the edge of a container and a lid having an end wall and an annular skirt, the lid being attached to and separable from the container engaging member at a failure zone. In one embodiment, the lid is adapted to reseal the container after it is separated from the container engaging member by turning the lid upside down and positioning it such that the annular skirt engages the container engaging member and the end wall covers at least a portion of the opening of the container. In another embodiment, the lid is also adapted to reseal the container after it is separated from the container engaging member by positioning the lid such that the annular skirt engages the container engaging member and the end wall covers at least a portion of the opening of the container.

The invention also includes a stackable container comprising a container body having a base and a sidewall, the sidewall terminating in an edge which defines an opening, and a closure comprising a container engaging member fixedly attached to the edge of the container and a lid having an end wall and an annular skirt, the lid being attached to and separable from the container engaging member at a failure zone. The container engaging member forms an annular shoulder extending radially outwardly from the lid. The container base further defines a recessed portion which enables stacking of a plurality of containers one on top of each other, such that the top container rests on and is supported by the annular shoulder formed by the container engaging member of the bottom container. In this way, the weight of the top container will not be wholly distributed on the lid of the bottom container.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
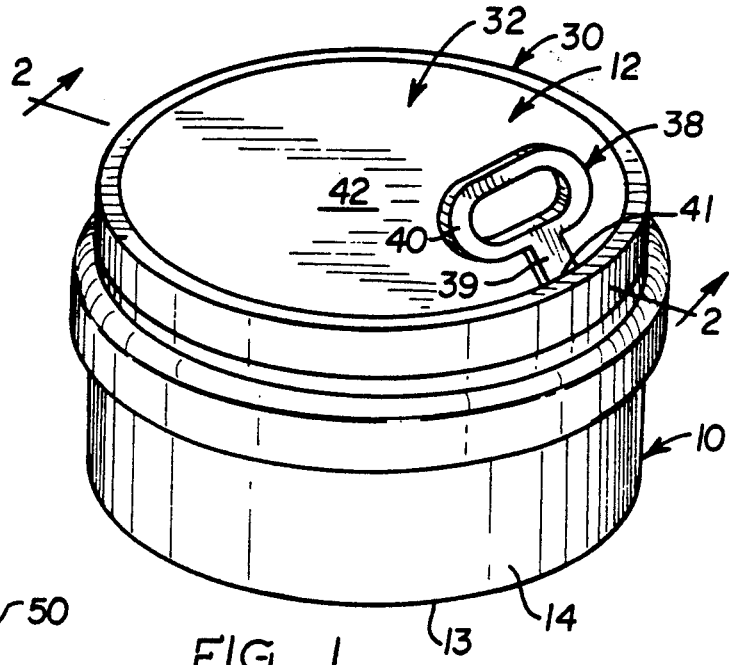
FIG. 1 is an isometric view of a container including the resealable closure of the invention.

Referring to FIG. 1, the container 10 and the closure 12 of the invention are shown. The container 10 consists of a base 13 and a continuous sidewall 14 which terminates in a top edge defining an opening (not shown). The container 10 and the closure 12 can be made of a suitable thermoplastic material, such as by way of example only, polypropylene, high density polyethylene, low density polyethylene, polyethylene terephthalate (PET) or polyvinyl chloride.

Figure 3:
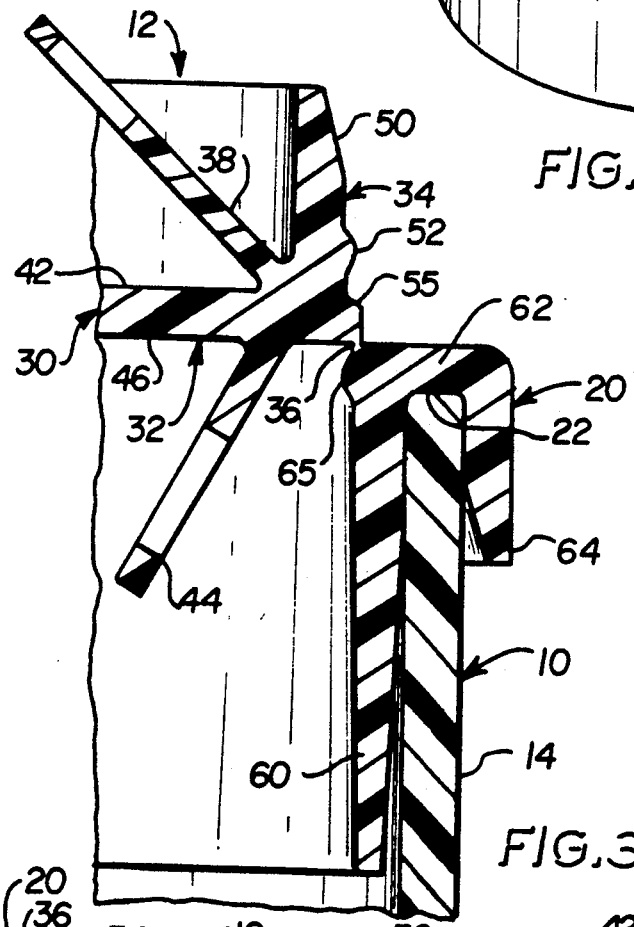
FIG. 3 is an enlarged detailed view of a portion of FIG. 2 showing the lid and container engaging member of the resealable closure of FIGS. 1 and 2.
Figure 2:
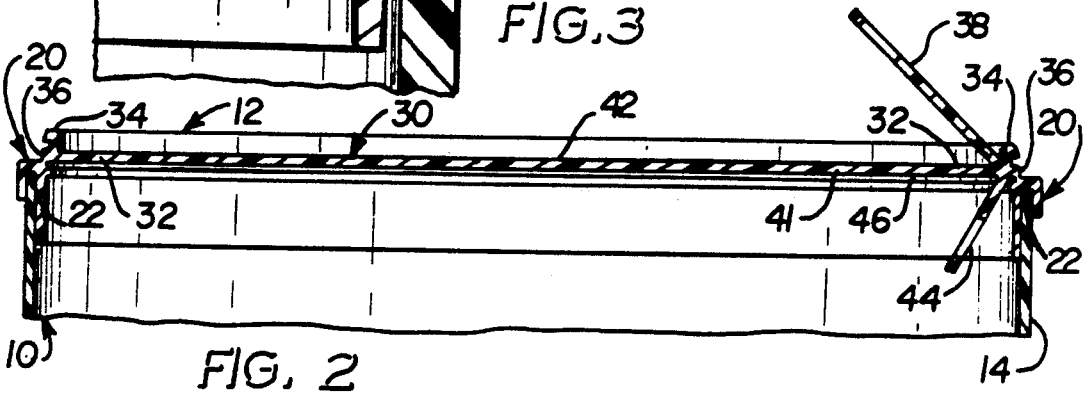
FIG. 2 is a cross-sectional view taken through line 2—2 of FIG. 1.

The closure 12 is best described by referring to FIGS. 2 and 3. This closure 12 includes an annular container engaging member 20 which is fixedly attached to the edge 22 of the sidewall 14 of the container 10 by means of, for example, ultrasonic welding, induction heating or application of an adhesive. A lid 30, having a circular end wall 32 and an annular skirt 34, is attached to the container engaging member 20 at a circular failure zone 36. The failure zone 36 extends axially between the lid 30 and the container engaging member 20. The lid 30 can be separated from the container engaging member 20 at the failure zone 36, as will be explained below. The failure zone 36 should be oriented axially in order to facilitate sealing of the lid 30 once it is removed and subsequently resealed on the container. That is, the failure zone 36 extends axially so that the diameter of the outer surface of the flange 55 is greater than the diameter of the annular rib 65 when the lid is turned upside down to reseal the container as will be explained below.

Figure 3A:
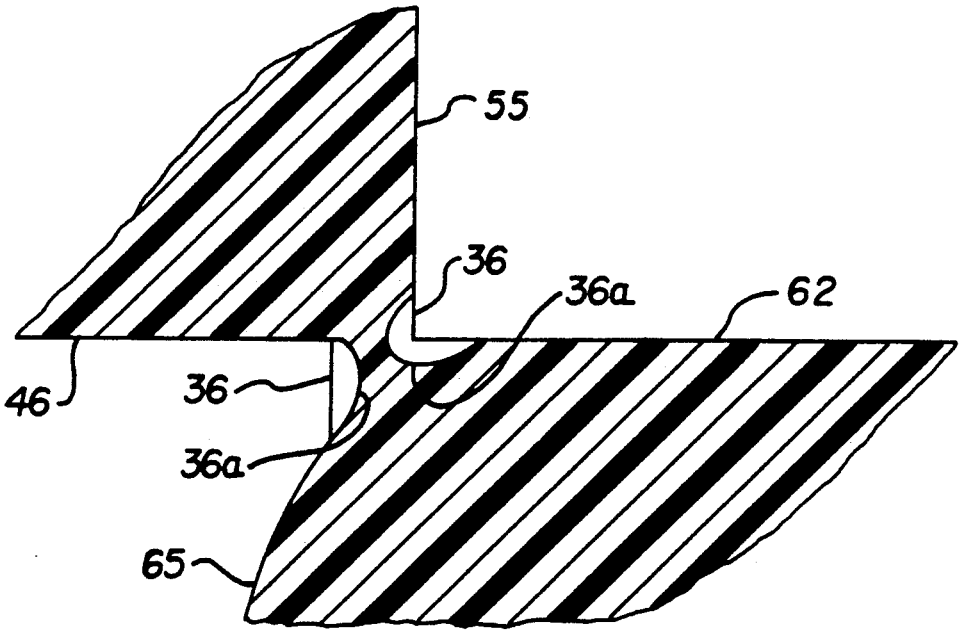
FIG. 3A is an enlarged detailed view of a portion of FIG. 3 showing the failure zone connecting the lid and the container engaging member of the resealable closure of FIGS. 1 and 2.

The lid 30 further includes a first pull tab 38 disposed on the top surface 42 of the end wall 32 and a second pull tab 44 disposed on the bottom surface 46 of end wall 32. Referring back to FIG. 1, the first pull tab 38 consists of a base portion 39 and an integral ring portion 40 to facilitate a user placing a finger therein. The base portion 39 of the pull tab 38 is attached to the lid surface 42 at area 41. The failure zone 36 around area 41 may be thinner than the remaining part of the failure zone as shown at 36*a* in FIG. 3A. This will facilitate tearing the lid 30 away from the container engaging member 20.

Referring more particularly now to FIG. 3, a detailed view of the lid 30 attached at failure zone 36 to the container engaging member 20 is shown. The annular skirt 34 of the lid 30 has a bevelled end 50, a first external annular rib 52, and an annular flange 55. The container engaging member 20 has a first annular wall 60, an annular shoulder 62 and a second annular wall 64. The first annular wall 60 also has an inner annular rib 65. The container 10 is designed to fit into the space created by the annular container engaging member 20. It will be appreciated that the annular container engaging member 20 can be fixedly attached to the edge 22 of the container 10 at any point along the outer surface of annular wall 60, the inner surface of annular wall 64 and the under surface of annular shoulder 62.

Figure 4:
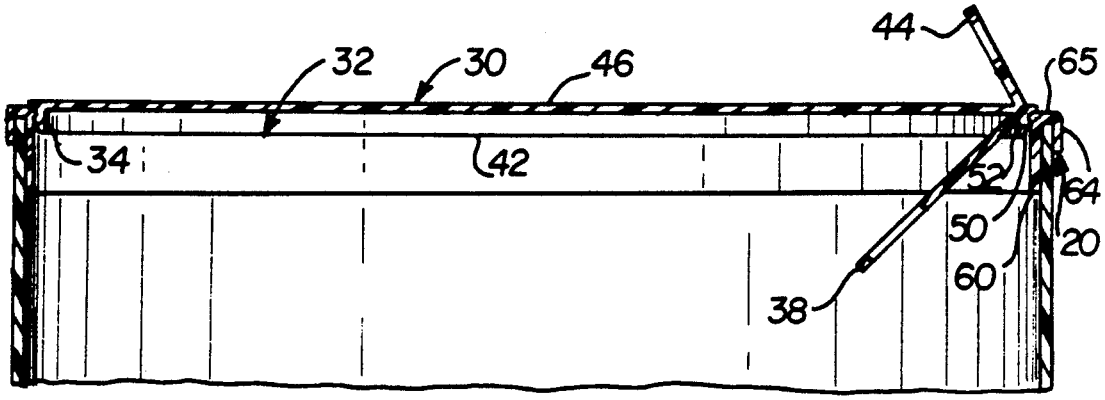
FIG. 4 is a cross-sectional view of the container and the closure after the lid has been removed from the container engaging member, turned upside down and resealed to the container.
Figure 5:
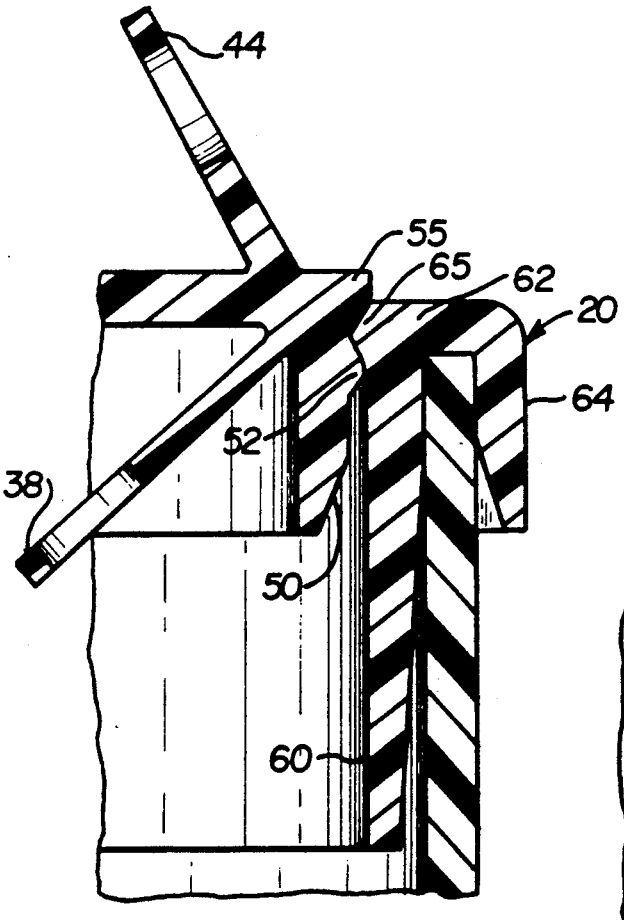
FIG. 5 is an enlarged detailed view of the lid engaging the container engaging member as shown in FIG. 4.

The lid 30 is separated from the container engaging member 20 by grasping the ring portion 40 of first pull tab 38 and tearing the lid 30 at the failure zone 36. Once the lid 30 is fully removed from the container engaging member 20, it can be used to reseal the container 10. Referring to FIGS. 4 and 5, the lid 30 is merely turned upside down so that the second pull tab 44 faces upwardly and so that the annular skirt first rib 52 engages second annular rib 65. Annular ribs 52 and 65 constitute cooperating sealing means that are engaged when the lid 30 is properly positioned on container engaging member 20. It will be appreciated that bevelled end 50 facilitates placement of the lid 30 onto the container 10 and also eases pushing down the lid 30 in position on the container engaging member 20. In addition, flange 55 seats on annular shoulder 62 to provide another sealing surface.

If it is desired to once again open the container, the second pull tab 44 is engaged and the lid 30 is merely peeled away from the container engaging member 20.

Figure 6A:
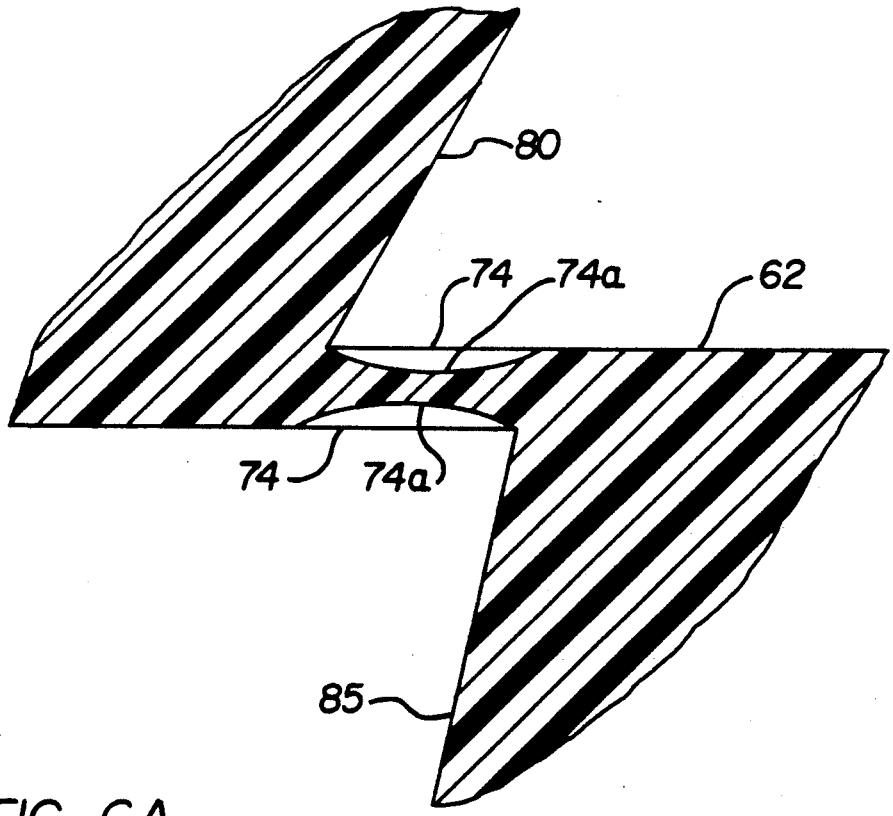
FIG. 6A is an enlarged detailed view of the failure zone connecting the lid and the container engaging member of the resealable closure of FIG. 6.
Figure 6:
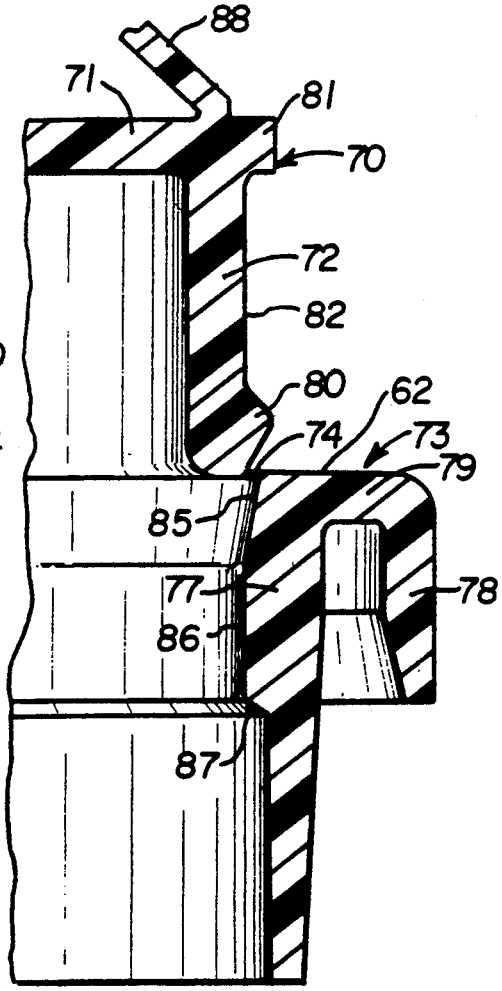
FIG. 6 is an enlarged detailed cross-sectional view of another embodiment of the invention showing particularly the lid and container engaging member.
Figure 7:
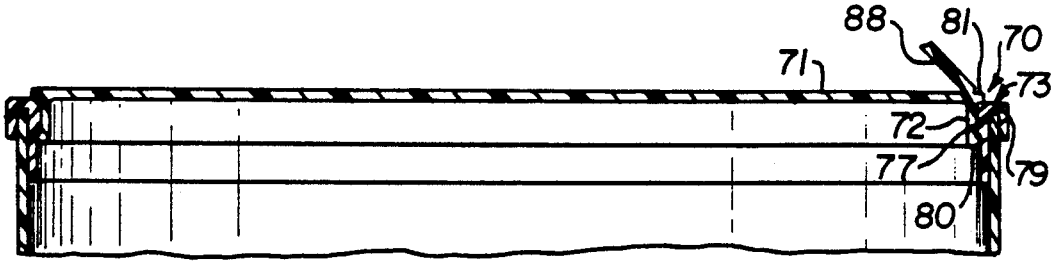
FIG. 7 is a cross-sectional view of the container and closure of FIG. 6 after the lid has been removed from the container engaging member and resealed to the container.
Figure 8:
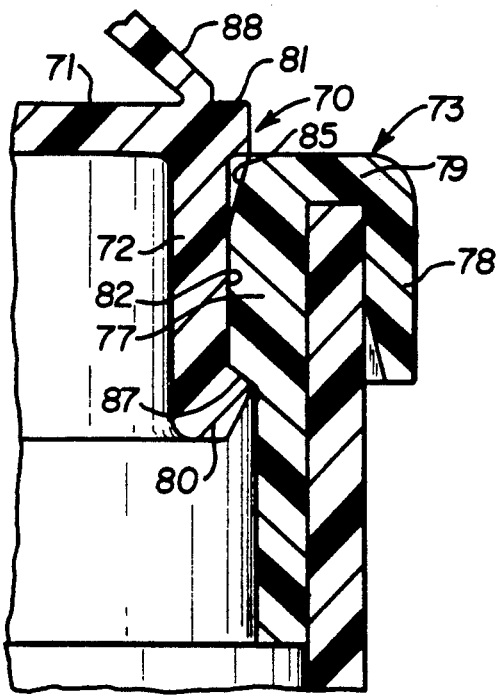
FIG. 8 is an enlarged detailed view of the lid engaging the container engaging member as shown in FIG. 7.

FIGS. 6–8 show another embodiment of the invention in which the lid is not turned upside down for resealing. In this embodiment, a lid 70 having an end wall 71 and an annular skirt 72 is attached to a container engaging member 73 at a radially extending failure zone 74. The container engaging member 73 consists of a first annular wall 77 and a second annular wall 78 joined by an annular shoulder 79.

The annular skirt 72 has an annular rib 80 and an annular flange 81 extending radially outward from the outer surface 82 of the annular skirt 72. The first annular wall 77 has a bevelled portion 85 on its upper end extending from surface 86 of the annular wall 77. The annular wall 77 also has an undercut 87 at its lower end that angles from surface 86 of the annular wall. A pull tab 88 is provided on lid 70. As with the FIG. 1 embodiment, the failure zone 74 adjacent to the pull tab 88 may be thinner than the remaining part of the failure zone. This is shown more particularly at 74*a* in FIG. 6A.

The lid 70 is removed from the container engaging member 73 by grasping pull tab 88 (as with the FIG. 1 embodiment) and tearing the lid 70 at failure zone 74. As shown in FIG. 7, the lid 70 is resealed to the container by pressing the lid 70 down so that the annular skirt 72 engages the first annular wall 77. The upper bevelled portion 85 will act as camming surface for facilitating pushing down the annular rib 80. As can best be seen in FIG. 7, annular rib 80 will engage the container engaging member 73 at undercut 87. The annular flange 81 will seat on annular shoulder 79 and outer surface 82 of lid 70 will form an interference fit with inner surface 86 of container engaging member 73 to further seal the lid 70 to the container.

Figure 9:
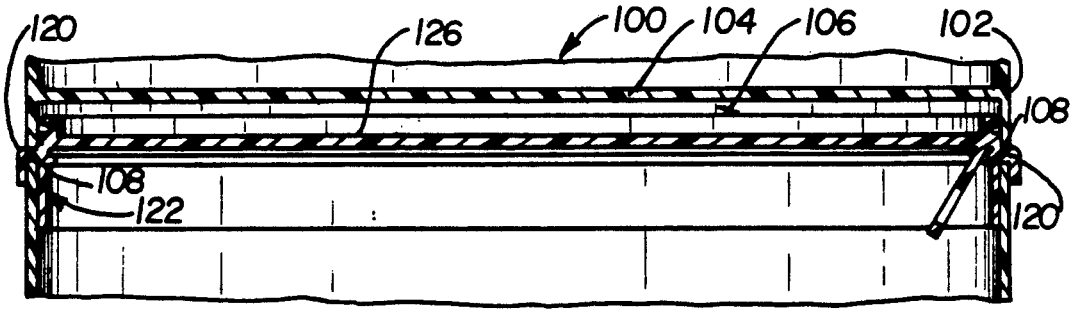
FIG. 9 is a cross-sectional view showing a top container stacked on a bottom container.

The stacking feature of the invention is shown in FIG. 9. The top container 100 is shown partially, the top container 100 having a sidewall 102 and a base 104. The base 104 defines a recessed area 106, such that the sidewall bottom edge 108 is lower than the base wall 104 bottom edge 110. This configuration will enable the sidewall bottom edge 108 to rest on and be supported by the annular container engaging member in the form of an annular shoulder 120 on a bottom container 122. In this way, the weight of the top container 100 will not be wholly distributed on the lid 126 of the bottom container 122. In addition, the weight of the top container will not be pressing against the lid of the bottom container thus preventing premature separation of the bottom container lid at the failure zone. Finally, because the bottom container lid extends axially upward, it acts to center the top container thereon to facilitate better stacking of a plurality of containers.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

I claim:

1. A closure for a container, said container having an opening defined by an edge of said container, said closure comprising:

an annular container engaging member, fixedly attached to said edge of said container and having an inner surface of a first diameter;

a lid having an end wall and an annular skirt, said annular skirt having an outer surface of a second diameter which is no greater than said first diameter, said lid being attached to and separable from said container engaging member at a failure zone extending generally radially between said inner surface of the annular container engaging member and said outer surface of said annular skirt;

said lid being adapted to reseal said container after said lid is separated from said container engaging member by positioning said lid such that said annular skirt engages said container engaging member and said end wall covers at least a portion of said opening of said container; and cooperating sealing means on said outer surface of said annular skirt and on said inner surface of said container engaging member which are separate from said failure zone and which radially overlap said failure zone and each other, said sealing means being engaged when said lid is used to reseal said container.

2. The closure of claim 1, wherein said sealing means are an annular rib on said outer surface of said annular skirt having an outer diameter greater than said first diameter and an annular undercut defined by said inner surface of said container engaging member also having an outer diameter greater than said first diameter.

3. The closure of claim 2, including an annular flange on said annular skirt which seats on said container engaging member when said lid is resealed to said container engaging member.

4. A closure for a container, said container having an opening defined by an edge of said container, said closure comprising:

a container engaging member, said container engaging member having an inner surface and said container engaging member being fixedly attached to said edge of said container;

a lid having an end wall and an annular skirt, said annular skirt having an outer surface, said lid being attached to and separable from said container engaging member at a failure zone;

said lid being adapted to reseal said container after said lid is separated from said container engaging member by positioning said lid such that said annular skirt engages said container engaging member and said end wall covers at least a portion of said opening of said container;

cooperating sealing means comprising an annular rib on said outer surface of said annular skirt and an annular undercut on said inner surface of said container engaging member, said sealing means being engaged when said lid is used to reseal said container; and said container engaging member further having a bevelled upper portion so as to facilitate resealing of said lid to said container engaging member.

5. The closure of claim 4, including a pull tab disposed on said end wall to facilitate separating said lid from said container engaging member.

6. The closure of claim 5, wherein said pull tab has a base portion connected to said end wall and an integral ring portion connected to said base portion.

7. The closure of claim 6, wherein said failure zone is thinner in cross-section near said pull tab to assist separation of said lid from said container engaging member.

8. A stackable container comprising:

a container body having a base and a sidewall, said sidewall terminating in an edge which defines an opening; and a closure comprising:

a container engaging member, said container engaging member having an inner surface and said container engaging member being fixedly attached to said edge of said container; and a lid having an end wall and an annular skirt, said annular skirt having an outer surface, said lid being attached to and separable from said container engaging member at a failure zone;

said container engaging member forming an annular shoulder extending radially outwardly from said lid;

said container base further defining a recessed portion which enables stacking of a plurality of containers one on top of another, such that the one container rests on and is supported by the annular shoulder formed by the container engaging member of said another container with said recessed portion of the base of said one container spaced from the lid of said another container, whereby the weight of said one container will not be distributed on the lid of said another container.

9. The container of claim 8, wherein said lid is adapted to reseal said container after said lid is separated from said container engaging portion by positioning said lid such that said annular skirt engages said container engaging member and said end wall covers at least a portion of said opening of said container.

10. The container of claim 9, wherein cooperating sealing means on said outer surface of said annular skirt and on said inner surface of said container engaging member, said sealing means being engaged when said lid is used to reseal said container.

11. The container of claim 10, wherein said sealing means are an annular rib on said annular skirt and an annular undercut defined by said inner surface of said container engaging member.

12. The container of claim 11, including an annular flange on said annular skirt which seats on said container engaging member when said lid is resealed to said container engaging member.

13. The container of claim 12, wherein said container engaging member has a bevelled upper portion so as to facilitate resealing of said lid to said container engaging member.

14. The container of claim 13, including a pull tab disposed on said end wall to facilitate separating said lid from said container engaging member.

15. The container of claim 14, wherein said pull tab has a base portion connected to said end wall and an integral ring portion connected to said base portion.

16. The container of claim 15, wherein said failure zone is thinner in cross-section near said first pull tab to assist separation of said lid from said container engaging member.

* * * * *